US005402623A

United States Patent [19]

Ahlers

[11] Patent Number: 5,402,623

[45] Date of Patent: Apr. 4, 1995

[54] METHOD AND APPARATUS FOR CLOSING BOTTLES

[75] Inventor: Egon Ahlers, Neutraubling, Germany

[73] Assignee: Krones AG Hermann Kronseder Maschinenfabrik, Neutraubling, Germany

[21] Appl. No.: 31,362

[22] Filed: Mar. 15, 1993

[30] Foreign Application Priority Data

Mar. 17, 1992 [DE] Germany ..... 42 08 441.5

[51] Int. Cl.[6] ..... B65B 3/04; B65B 7/28; B67B 3/064

[52] U.S. Cl. ..... 53/471; 53/488; 53/268; 53/281

[58] Field of Search ..... 53/306, 308, 312, 357, 53/362, 281, 343, 359, 268, 270, 471, 488

[56] References Cited

U.S. PATENT DOCUMENTS

| | | | |
|---|---|---|---|
| 1,041,527 | 10/1912 | Taylor | 53/343 X |
| 1,928,450 | 9/1933 | Gaynor | 53/281 X |
| 1,953,642 | 4/1934 | Calleson | 53/272 |
| 2,885,845 | 5/1959 | Ryan, Jr. | 53/268 X |
| 3,308,604 | 3/1967 | Nekola | 53/343 |
| 5,050,369 | 9/1991 | Fiwek et al. | 53/306 X |

FOREIGN PATENT DOCUMENTS

| | | |
|---|---|---|
| 0470360A2 | 2/1992 | European Pat. Off. . |
| 9108960.3 | 10/1991 | Germany . |
| 4018121 | 12/1991 | Germany . |
| 4039434 | 6/1992 | Germany . |

*Primary Examiner*—Horace M. Culver
*Attorney, Agent, or Firm*—Finnegan, Henderson, Farabow, Garrett & Dunner

[57] ABSTRACT

In a machine for closing a filled bottle wherein a bottle is removed from the filling valve of a filling device and closed in a closing device by placing and flanging a crown cap to the bottle's opening to permit a tight closing of the bottle in a simple way and within the shortest time possible, the crown cap which is kept ready in the closing device and a closing tool which is used for flanging the crown cap are positioned in a positioning phase between bottle's opening and the filling valve to immediately close the filled bottle, and the crown cap is then placed on the bottle opening without pressure being exerted on the top thereof, and the closing phase is then initiated.

33 Claims, 3 Drawing Sheets

METHOD AND APPARATUS FOR CLOSING BOTTLES

This invention relates to a method and an apparatus for performing the method for closing bottles, wherein a filled bottle is removed from a filling valve of a filling means and is closed in a closing means by placing and flanging a crown cap.

Such a method and apparatus for performing the method are known from DE 40 18 121. A plurality of bottles are consequently filled in a rotary filling means and crown caps are flanged along their crown edge by a closing cone in a downstream closing means. During the flanging operation the crown caps are pressed by a holding-down means with an additional force of about 80 kp (top pressure) onto the bottle opening. A preclosing means which projects into a free space formed between bottle opening and filling valve in the rotary filling means, i.e. after removal of the bottle from the filling means, and which places a crown cap on the bottle opening is arranged between the closing means and the rotary filling means. The crown cap is then pressed with a force of about 20 kp onto the bottle opening. The crown cap is secured to the bottle by pointwise deformation of the crown edge.

The method of the prior art has the disadvantage that the bottles must be transported from the rotary filling means to the closing means between the preclosing phase and the final closing phase of the bottles. Although, during this transfer period from filling means to closing means, foam or liquid is largely prevented from exiting by preclosing the crown cap, degassing of the filled-in liquid or entry of air cannot always be prevented. This deteriorates the durability or quality of the filled-in product.

Another disadvantage is that a relatively high top pressure is generated in the closing means. This top pressure may effect a disadvantageous deformation of the sealing material in the crown cap. A damaged or even destroyed sealing material, in turn, effects an inadequate closure of the bottle, possibly resulting in a degasification of the liquid or in the entry of air. Although the arrangement of the closing means offers some advantages due to the quick preclosure of the bottles, the construction becomes more troublesome and expensive due to this additional component. Likewise, maintenance becomes more cumbersome and expensive.

It is therefore the object of the present invention to improve a bottle closing method of the above-mentioned type with a view to a simplified and tight closing of the bottles within a shorter period of time.

This object is solved by the present invention in that the crown cap which is kept ready in the closing means and a closing tool which is used for flanging the crown cap are inserted in a positioning phase between bottle opening and filling valve for immediately closing the filled bottle and the crown cap is then placed on the bottle opening without any pressure being exerted on the top thereof, and the closing phase is initiated.

As soon as the bottle is entirely filled in the filling means and removed from the filling valve, the holding element and the closing tool can be introduced into the free space formed between bottle opening and filling valve. The crown cap which is kept ready by the holding element can already be placed on the bottle opening when the bottle is still positioned in the filling means. An additional force which serves to press the crown cap onto the bottle opening is not applied, so that the crown cap rests on the bottle opening virtually without any pressure being exerted on the top thereof. The crown edge is flanged by the closing tool and sealingly secured to the bottle directly following the positioning phase. Even with a high bottle throughput the bottles are entirely closed shortly after their exiting from the filling means and can be transported away for further processing, such as labelling.

Since the bottles are closed without pressure being exerted on the top thereof, a reduced overall height of the closing means is possible due to the absence of force applying means, and a disadvantageous deformation of the sealing material in the crown cap is prevented. Since the bottles need no longer be preclosed, the construction of the system for filling and closing bottles is simplified and becomes less expensive. At the same time, the bottles are fully closed within a considerably shorter period of time, with the pressure load on the bottles being substantially reduced.

In an advantageous embodiment of the invention, the closing tool for flanging the crown cap is lowered towards the bottle opening and subsequently lifted for releasing the closed bottle. The closing tool is movably supported on the closing means for vertical adjustment between holding element and bottle opening. A quick and exact deformation of the crown cap is possible due to the simple upward and downward movements.

In this respect it is also of advantageous when the closing tool flanges an edge of the crown cap by means of a closing cone. When the crown cap holding element and the closing tool are moved into the free space formed between bottle opening and filling valve, the closing cone is directly positioned above the bottle opening. During the upward and downward movement of the closing tool the closing cone flanges the crown edge with its conical surfaces and can be removed from the bottle opening in a simple way after deformation of the crown cap. The bottle is then fully closed and can be transported away.

A bottle filled in the filling means can be assigned with respect to the ready crown cap and the closing tool, respectively, in an advantageous way in that the closing means is formed as a rotary closing means, with filling means and closing means being arranged in partly overlapping fashion. The filling means is formed as a so-called rotary filling means in this case. Filling means and closing means overlap in a circumferential portion, with crown caps and closing tool being positioned above the bottle opening in this portion.

To permit the upward and downward movement of the closing tool in a simple way, this tool is lowered and lifted by means of a cam roller which is guided in a guide cam. The cam roller is rotatably supported on the closing tool and is guided in a guide cam stationarily arranged relative to the closing means.

To transfer the bottles between filling means and closing means in a simple way, the bottles in the filling means are positioned on a lifting disc and gripped by the closing means through a holding arm on the bottle neck. The holding arm has a substantially U-shaped reception opening which faces the bottle and into which the bottle is slid in the overlapping portion of filling means and closing means. When the closing tool is lowered or lifted, the corresponding counterforce can be applied by the holding arm for positioning the bottle in a stable way, as the counterforce is reduced for the reason that the closing operation is carried out without any top pressure.

In an embodiment of the invention the bottle is removed by the holding arm from the lifting disc after the positioning phase. In this case the deformation phase takes place owing to the cooperation of holding arm and closing tool without any discs supporting the bottom of the bottle.

In the embodiment of the invention the holding element may be arranged above the closing cone in fixed manner relative thereto, whereas in another embodiment the holding element may movably be supported in the closing cone and pushed out of the closing cone after the crown cap has been positioned on the bottle opening, so that it can act as an ejector.

If the holding element is to serve as an ejector at the same time, it is positioned directly above the crown cap in horizontal fashion when the closing tool is being lifted, and will remain in this position until the closing tool or the closing cone of the closing tool has released the bottle opening and the crown cap, respectively. To achieve such a condition, it is advantageous when the holding element which acts as an ejector is controlled with respect to the vertical position independently of the closing tool. In this variant at least the following steps are taken in the method:

lowering the closing tool;

lowering the holding element from an initial position to a position directly above the crown cap or in contact therewith without any top pressure;

lifting the closing tool after flanging, with the holding element being simultaneously retained in the position assumed in the lowering step of the holding element until the crown cap gets out of contact with the closing cone of the closing tool and lifting the holding element and the holding tool into the initial position.

When the holding element is positioned in the lowered position, the holding element need not come into direct contact with the crown cap. Rather, it is sufficient when it is positioned directly above the crown cap. A possible vertical displacement between holding element and closing tool is here chosen to be at least so great that the holding element can reliably press the crown cap and the bottle opening closed with the crown cap out of the closing cone of the closing tool.

The vertical adjustment of the holding element as well as the vertical adjustment of the closing tool are advantageously performed by means of a cam roller guided in a guide cam.

In an embodiment of the invention a holding arm may be assigned to a respective closing tool. In another embodiment the closing means may have a bottom plate which comprises recesses respectively assigned to a closing tool along the circumference thereof. The bottles can be slid thereinto together with their bottle necks. In an advantageous embodiment of the invention a cover plate is arranged opposite to the bottom plate for concluding the closing means upwards. Both bottom plate and cover plate have substantially the same diameter.

The solutions and advantageous embodiments suggested in accordance with the invention shall now be explained and described in the following with reference to the figures shown in the drawing, wherein.

Figure 1:
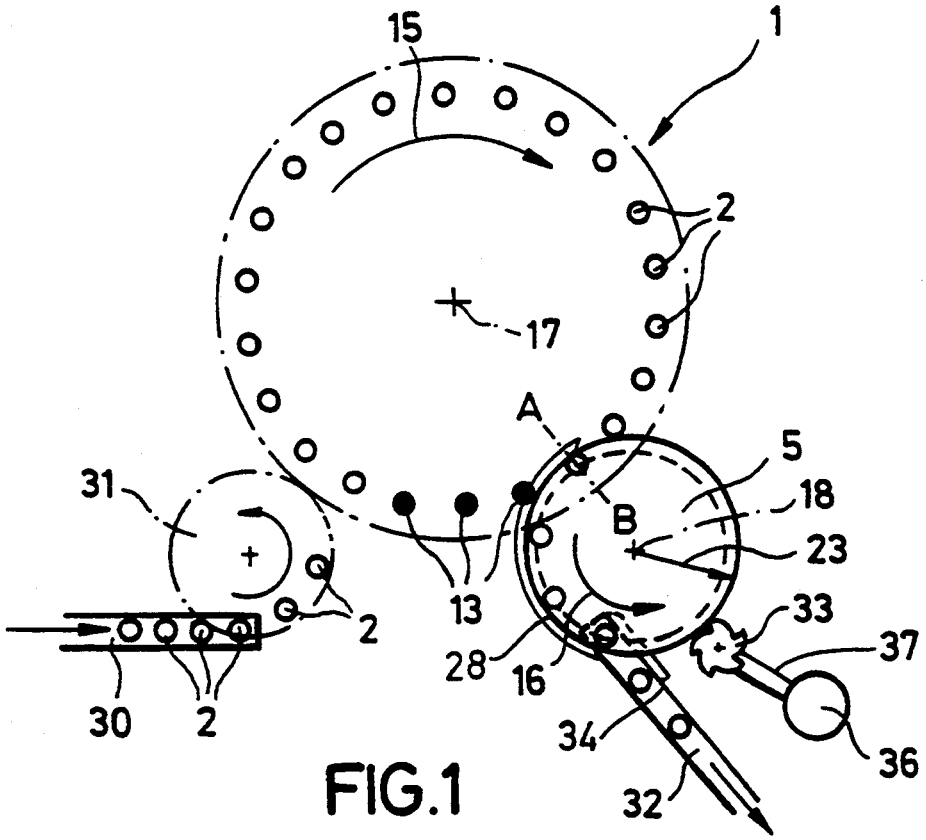
FIG. 1 is a top view of a closing means of the invention with an associated filling means.

In FIG. 1 reference numeral 1 designates a filling means which is designed as a rotary filling means in the present embodiment. A multitude of liftable and lowerable lifting discs 13 on which bottles 2 can be positioned are distributed at regular intervals over a circular circumference of the rotary filling means. Filling valves (not shown in FIG. 1) are arranged with associated centering bells above bottle openings. Filling means 1 is fed with empty bottles 2 via a supply belt 30 and a star-shaped inlet means 31. Bottles 2 are filled during rotation of the rotary filling means 1 about its vertical rotary axis 17 in the rotary direction 15. At the end of the filling operation a rotary closing means 5 partly overlaps the rotary filling means 1. Bottles 2 are closed in the rotary closing means 5 and further transported to a discharge belt 32 at the end of the closing operation. Discharge belt 32 transports the bottles to other processing stations (not shown), such as a labeller. The lifting discs 13 which are arranged between rotary closing means 5 and star-shaped inlet means 31 are empty and can only be loaded by the star-shaped inlet means 31 with empty bottles 2.

The rotary closing means 5 rotates about its rotary axis 18 in the rotary direction 16. The rotary directions 15 and 16 of the rotary filling means 1 and the rotary closing means 5, respectively, are opposite to each other, the rotary filling means 1 being rotatable clockwise and the rotary closing means 5 anticlockwise.

To supply the rotary closing means 5 with crown caps (not shown), the same communicates at one point of its circumference with a crown-cap feeding means 33. In synchronism with the rotary closing means 5, crown caps which have been supplied from a crown-cap supply container 36 via a chute 37 are fed by said crown-cap feeding means to the rotary closing means 5.

Bottles 2 are closed in the rotary closing means 5 in the embodiment shown in FIG. 1 between section line A-B and discharge belt 32.

The rotary closing means 5 has a smaller radius 23 in comparison with the rotary filling means 1.

Figure 2:
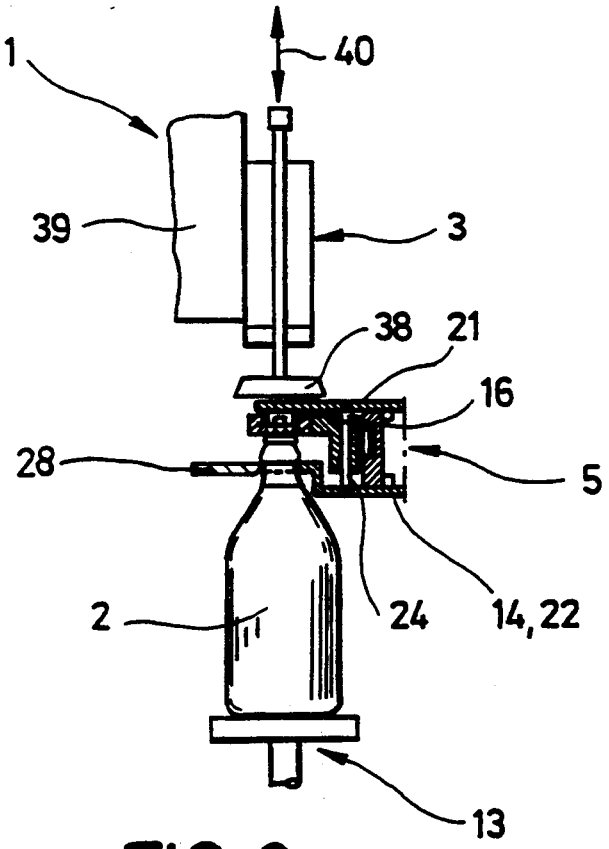
FIG. 2 is a sectional view taken along the line A-B in FIG. 1.

With reference to FIG. 2, a bottle 2 is positioned on a lifting disc 13. A filling valve 3 is arranged with a centering bell 38 above the filled bottle in spaced relationship with bottle 2. The lifting disc 13 is adapted to be lowered and lifted in direction 40 in the embodiment shown. The filling valve 3 communicates with a liquid container 39 of the rotary filling means 1 for filling the bottles.

Figure 3:
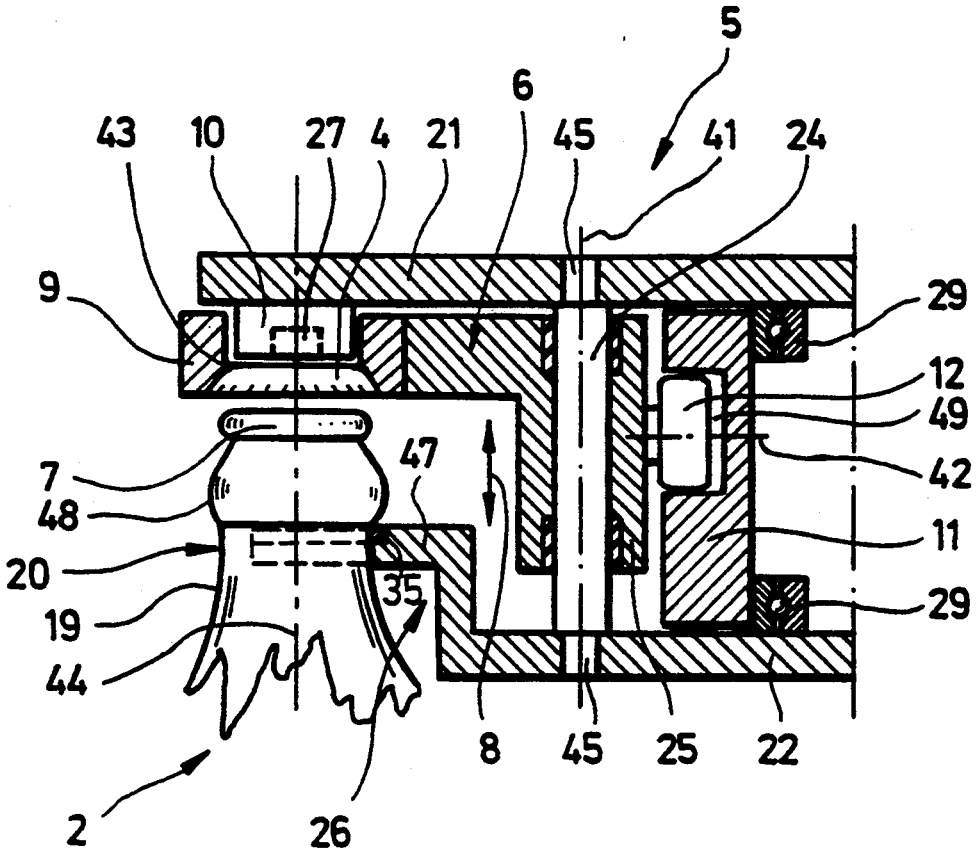
FIG. 3 is an enlarged representation of a closing tool.

Part of the rotary closing means 5 is introduced between centering bell 38 and bottle 2. As shown in FIG. 3, a closing tool 6 is supported in a vertically adjustable way on a guide pin 24 between a holding arm 14, FIG. 6 or a bottom plate 22 and a cover plate 21, respectively.

Closing tool 6 is supported in a vertically adjustable way in direction 8 on guide pin 24 according to FIG. 3. This pin is fixed with its ends 45 in the cover plate 21 and bottom plate 22. The cover and bottom plates 21 and 22 are arranged in parallel with each other, the bottom plate 22 being offset by a step-like vertical offset 26 towards the cover plate 21 at its retaining end 47 associated with bottle 2. The retaining end 47 has a reception opening 20 for receiving a bottle neck 19. To retain bottle 2, the same is positioned with a thickened bottle collar 48 arranged below the bottle opening 7 on the retaining end 47 surrounding the reception opening 20. When being viewed from the top, the reception opening 20 is substantially U-shaped and adapted to the diameter of the bottle neck 19 below the bottle collar 48.

The closing tool 6 is substantially L-shaped, with one leg thereof being formed as a guide sleeve 25. This guide sleeve extends concentrically relative to the longitudinal axis 41 of the guide pin 24. To adjust the guide sleeve 25 vertically, said sleeve has a cam roller 12 at the side opposite to bottle 2, the rotary axis 42 of said cam roller being substantially perpendicular to the longitudinal axis 41 of the guide pin. The cam roller 12 is inserted in a per se closed guide groove 49 of a stationary guide cam 11. The closing tool 6 is vertically adjusted in direction 8 through movement of the cam roller 12 along the guide groove 49.

The guide cam 11 is fixed relative to the rotary closing means 5. When the rotary closing means 5 is rotated in direction 16 according to FIG. 1, cover plate 21 and bottom plate 22 rotate along the guide cam 11 via ball bearings 29 arranged thereinbetween. Guide cam 11 is substantially arranged concentrically relative to the rotary axis 18 of the rotary closing means of FIG. 1.

The other L-shaped leg of the closing tool 6 is arranged between cover plate 21 and bottle opening 7. Said leg comprises a closing cone 9 at its end assigned to the bottle opening 7. The closing cone 9 has a substantially cylindrical bore which has conically enlarged surfaces 43 at its end facing the bottle opening 7. A crown cap 4 is held in the area of these surfaces. The crown cap is flush with the closing cone towards bottle 2. A holding element 10 is secured to the cover plate 21 for holding the crown cap in the closing cone 9. This holding element has an outer diameter corresponding to the inner diameter of the cylindrical bore of the closing cone. A magnet 27 is inserted in the holding element 10 such that it is flush with the surface of said element at its end facing the crown cap 4.

Crown cap 4, holding element 10, closing cone 9 and bottle opening 7 are concentrically arranged relative to the longitudinal axis 44 of the bottle.

Figure 4:
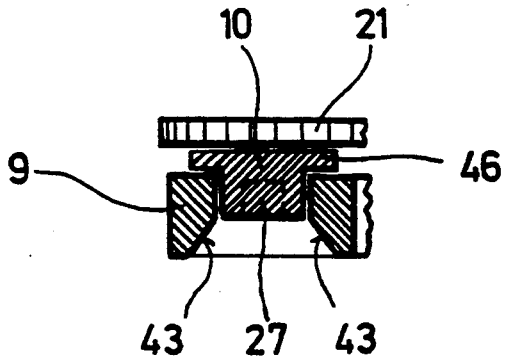
FIG. 4 shows an embodiment of a holding element.

FIG. 4 shows another embodiment of a holding element 10. Except for cover plate 21 and closing cone 9, all other components of the closing means 5 as well as bottle 2 are omitted for the sake of simplicity.

The holding element 10 is introduced into the cylindrical bore of the closing cone 9. The holding element 10 is formed between cover plate 21 and closing cone 9 with an edge flange 46 resting on the closing cone 9. To hold a crown cap (not shown), a magnet 27 is embedded in the holding element 10 opposite to the edge flange 46 in such a manner that it is flush with a surface of the holding element 10. The holding element 10 extends substantially between the cover plate 21 and the conical surfaces 43. When the closing cone 9 is being lowered, the loosely resting holding element 10 can be lowered to such an extent that the crown cap comes to rest on the bottle opening. When the closing cone 9 is further lowered, the holding element 10 can be pushed out of the cylindrical bore.

The invention shall now be explained in detail with reference to the figures.

The bottles 2 which are introduced into the overlapping portion of the rotary filling means 1 and closing means 5 are already filled, the bottles being withdrawn from the associated filling valves 3 by lowering the lifting discs 13 accordingly. Part of the closing means 5 is introduced into the free space formed between the bottle opening and the filling valve, the holding element which holds the crown cap and the closing cone of the closing tool being, in particular, positioned between filling valve and bottle opening. The positioning phase for positioning a crown cap above the bottle opening is ended in the case of the bottle arranged along line A-B of FIG. 1. Furthermore, the bottle neck 9 is fully inserted in the reception opening 20.

The crown cap is correctly positioned relative to the bottle opening in FIG. 2 and subsequently lowered onto the bottle opening.

In the embodiment of the holding element 10, which is shown in FIG. 3, the crown cap 4, which is held by magnet 27, is placed on the bottle opening 7 by lowering the closing cone 9 and flanged in the further course of the lowering process. The crown cap is sealingly secured to the bottle opening 7 at the end of the deformation process. The closing cone is subsequently lifted into the position shown in FIG. 3, and the closed bottles are transferred from the rotary closing means 5 to the discharge belt 32. In order to supply a new crown cap, a new crown cap is fed by the crown-cap feeding means 33 to the holding element 10 upon rotation of the rotary closing means 5 in direction 16.

Since the crown cap 4 substantially rests on the bottle opening 7 without the application of a force in both the embodiment of the holding element according to FIG. 3 and the embodiment according to FIG. 4, the bottles are closed without any pressure being exerted on the top thereof. The forces arising during the deformation of the crown edge are the only ones acting on the bottle opening and thus on the bottle. As a result of the small overall height of holding element and closing cone and the abutment of the crown cap on the bottle opening without any pressure on the top thereof, the crown cap can be deformed for closing the bottle directly subsequent to the removal of the bottle from the filling valve and at least partly even in the filling means.

The closing force produced by the closing cone 9 during the flanging of the crown cap 4 is introduced through the thickened bottle collar 48 directly into the holding end 47, so that no load acts on the trunk of the bottle. To permit an especially even introduction of forces, the reception opening 20 is provided with a replaceable insert 35 of a rigid, but nevertheless elastic material, the insert being substantially U-shaped when viewed from above. The counterforce which is required for removing the closing cone 9 after the deformation of the crown cap 4 is ensured through the vertical fixation of the bottle neck 19 in the reception opening 20, the holding element 10 acting as an ejector in case of need when bottle 2 is lifted excessively.

Bottle 2 is held in the reception opening 20 in radial direction, e.g., by clamping or by a recess for the bottle collar 48. Another possibility is shown in FIGS. 1 and 2. The bottle is here held by a guide section 28 which is stationarily arranged at the level of the holding end 47 between section line A-B and discharge belt 32. The closed bottles 2 are guided out of the reception openings 20 by means of a guide rail 34, which is also stationary. The guide rail 34 begins below the bottom plate 22 in the area of the discharge belt 32.

Figures 5, 6:
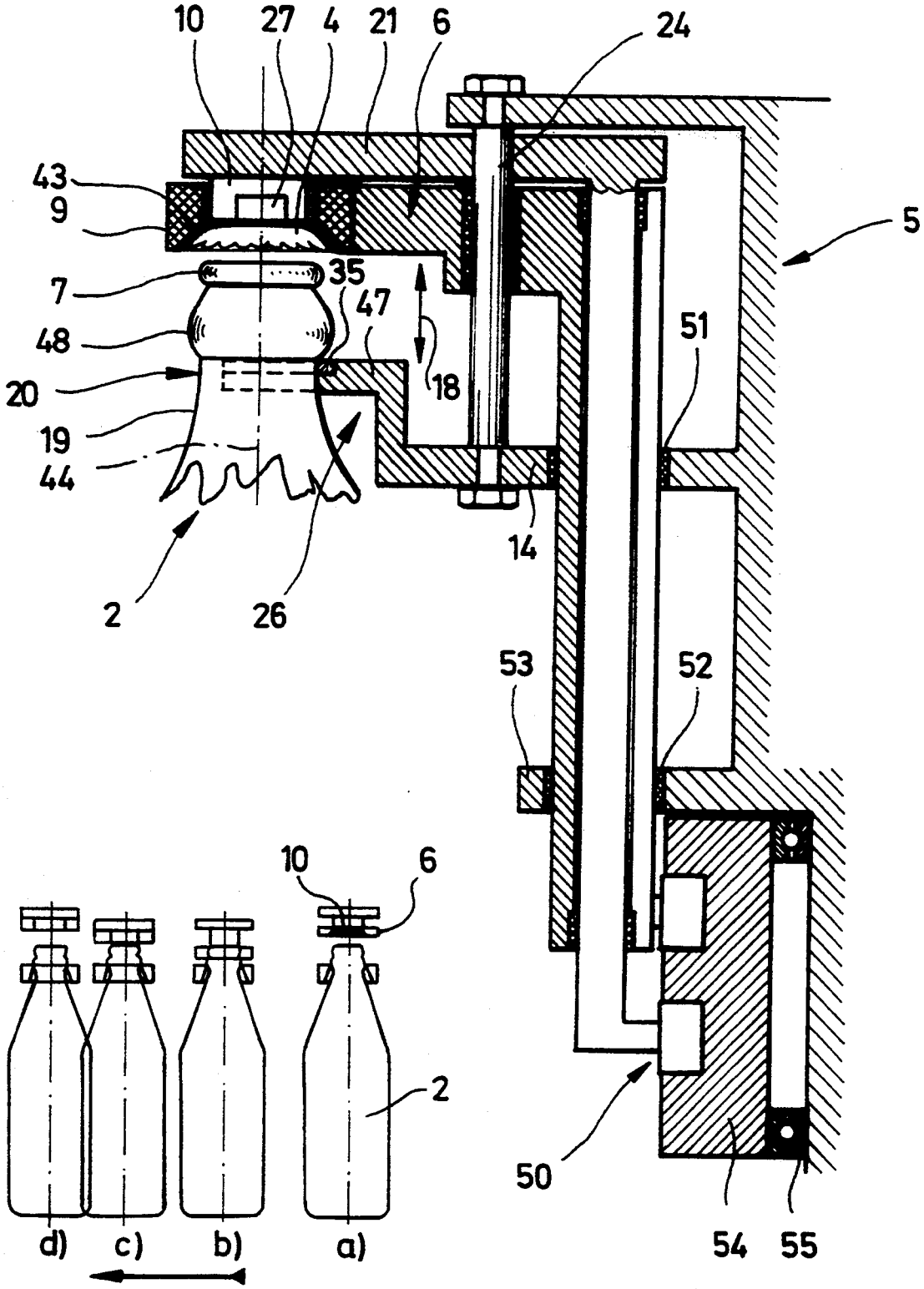
FIG. 5 shows another embodiment of a closing device of the invention.
FIG. 6 is a sketch explaining the method of closing bottles with the embodiment of FIG. 5.

Like in the embodiment shown in FIG. 3, the holding element 10 is arranged on the cover plate 21 in the embodiment shown in FIGS. 5 and 6. The cover plate, however, can be moved upwards and downwards together with the holding element through a separate cam guide 50 independently of the closing tool 6, which is also controlled in a vertically movable way. Both the closing tool 6 and the cover plate 21 are guided on the guide pin 24, which may be secured against rotation, and passage openings 51 and 52, respectively, in the holding arm 14 and a collar 53, respectively, which rotates on the rotor. The radial cam block 54 in which the control cam 50 for the holding element 10 and also the control cam for the closing tool 6 extend is stationarily arranged on the rotor via bearing 55.

The closing process, as is shown in FIG. 6 in steps a–d, can be carried out with this embodiment. As becomes apparent from this figure, both the closing tool 6 and the cover plate 21 with the holding element 10 are in their initial position at a place lifted above the bottle in such a way that the crown cap can be positioned below the holding element 10. In the next step the holding element is lowered together with the closing tool, the holding element being held in a position in which it rests on the crown cap in a more or less loose way, i.e. without exertion of a top pressure, or just above the crown cap which is loosely seated on the opening. The closing tool is now moved into the closing position shown in step b in which the edge of the crown cap is flanged. In step c the closing tool is then lifted again, so that the crown cap is released from the closing cone. The holding element keeps the position assumed in step b. The holding element therefore acts as an ejector when the closing tool 6 is lifted and makes sure that the bottles are reliably released from the closing cone. In step d the closing tool and the holding element are then moved again into the lifted initial position.

I claim:

1. In a method for closing bottles having an opening on the top thereof with crown caps, wherein the bottles are first filled by a filling valve in a filling device and thereafter closed in a closing device by flanging the caps around the openings of the bottles with a closing tool, the improvement comprising positioning in a positioning phase a closing tool holding a crown cap for closing the bottle between the filling valve of the filling device and the opening on the top of a bottle immediately after that bottle has been filled and while that bottle is beneath the filling valve but is spaced therefrom and is still in the filling device to place said crown cap on said bottle opening without any pressure being exerted on the top thereof and thereafter removing the bottle with the crown cap placed thereon from beneath the filling valve and closing the bottle in a closing phase with said closing tool in said closing device by flanging the crown cap around the bottle's opening.

2. The method of claim 1, wherein during the closing phase the closing tool is lowered towards said bottle's opening to flange said crown cap around said bottle's opening and is subsequently lifted away to release said closed bottle.

3. The method of claim 2, wherein said closing tool includes a closing cone for flanging an edge of said crown cap to the bottle's opening.

4. The method of claim 3, including holding the crown cap with a cap holding element in the closing tool during the positioning phase.

5. The method of claim 4, wherein said cap holding element holds said crown cap in said closing cone during the positioning phase.

6. The method of claim 2, including lowering and lifting said closing tool in the closing phase with a cam roller guided by a guide cam.

7. The method of claim 1, wherein said bottle has a thickened collar portion immediately below said opening and a thinner neck portion below the collar portion and wherein during the positioning phase, the bottle is supported in said filling device at the bottom thereof on a liftable disc and is simultaneously supported in said closing device by a holding arm engaging with the bottle's neck portion.

8. The method of claim 7, wherein the bottle is removed from said liftable disc of the filling device by said holding arm subsequent to the positioning phase and is supported by said holding arm during the closing phase.

9. The method of claim 5, wherein the cap holding element is movably supported with respect to said closing cone and is pushed out of said closing cone after said crown cap has been placed on said bottle opening.

10. The method of claim 5, wherein the cap holding element remains in a horizontal position directly above said crown cap during the closing phase so that when said closing tool is lifted away from a closed bottle, it ejects the crown cap now flanged to the bottle away from the closing cone.

11. The method of claim 10, wherein said holding element acting as an ejector is vertically positionable independently of said closing tool.

12. The method of claim 11, wherein at least the following steps occur during the closing phase:

a) lowering said holding element form an initial position to a position immediately above said crown cap or until it abuts the top of said crown cap in said closing cone without applying pressure on the top thereof;

b) lowering the closing tool towards said bottle opening to flange the cap thereon;

c) lifting said closing tool after flanging while simultaneously keeping said holding element in the position assumed in step a) for a time long enough until the crown cap is pushed out of said closing cone of said closing tool by the holding element; and d) then lifting the holding element to its initial position.

13. In an apparatus for the filling and closing of bottles having an opening on the top thereof with a filling valve that fills the bottles through the opening in a filling device and for subsequently closing the filled bottles with a crown cap in a closing device by flanging the caps around the openings of the filled bottles with a closing tool, said filling device and closing device being movable relative to one another and said closing tool including a holding element for holding a crown cap to be flanged in said tool, the improvement comprising positioning means for positioning said closing tool and said holding element holding a crown cap in said tool between the filling valve of the filling device and the opening on the top of a bottle immediately after that bottle has been filled and while the bottle is beneath the filling valve but is spaced therefrom and is still in the filling device to place said cap on said bottle's opening without any pressure being exerted on the top thereof and transport means for thereafter moving said bottle, closing tool and crown cap placed thereon to the closing device, where said cap is then flanged to the bottle's opening with the closing tool.

14. The apparatus of claim 13, wherein the closing tool includes a closing cone for flanging the crown cap to the bottle and the holding element holds the crown cap in the closing cone as the closing tool is being positioned by the positioning means.

15. The apparatus of claim 14, wherein the closing tool is vertically adjustable in said closing device between said holding element and the bottle's opening.

16. The apparatus of claim 15, wherein the closing device rotates and the paths of movement of said filling device and said closing device are partly arranged in overlapping relationship.

17. The apparatus of claim 16, wherein the closing device and the filling device rotate in opposite directions with respect to each other.

18. The apparatus of claim 17, wherein the axis of rotation of said closing device is in parallel with the axis of rotation of said filling device.

19. The apparatus of claim 16, wherein the bottle has a thickened collar portion below said opening and a thinner neck portion below said collar portion and said transport means includes a holding arm that engages with the neck portion of the bottle in the filling device at the same time that the closing tool and holding element are being positioned by the positioning means to support said bottle in the closing device.

20. The apparatus of claim 19, wherein said holding arm is directed radially outwards and has a U-shaped opening for receiving the neck portion of the bottle at a free end thereof.

21. The apparatus of claim 20, wherein said closing tool is vertically adjustable between the holding arm and a cover plate of the closing device spaced therefrom in an axial direction.

22. The apparatus of claim 21, wherein the holding arm and the cover plate are fixed relative to each other and rotatably supported about the axis of rotation of the closing device.

23. The apparatus of claim 22, wherein the holding arm is part of a bottom plate of the closing device.

24. The apparatus of claim 23, wherein that cover plate and bottom plate have substantially the same radius.

25. The apparatus of claim 24, wherein the closing tool is vertically adjustable along a guide located between said cover plate and said bottom plate.

26. The apparatus of claim 25, wherein said guide is a guide pin extending in parallel with the axis of rotation of the closing device.

27. The apparatus of claim 26, including a cam roller on said closing tool guided by a guide cam for controlling vertical adjustment of the closing tool.

28. The apparatus of claim 27, wherein the guide cam is stationary and said cam roller rolls in said guide as said closing device rotates.

29. The apparatus of claim 28, wherein said holding element is vertically adjustable relative to said closing tool.

30. The apparatus of claim 29, wherein said holding element is vertically adjustable by means of a cam roller guided by a guide cam.

31. The apparatus of claim 30, wherein said holding element is located in said closing tool with respect to said closing cone so that it is vertically displaceable towards said cover plate.

32. The apparatus of claim 23, wherein said bottom plate has a step-like vertical offset portion extending towards said cover plate, said holding arm being part of said offset portion.

33. The apparatus of claim 14, wherein said holding element is a magnet.

* * * * *